US009857091B2

(12) United States Patent
Robideau et al.

(10) Patent No.: US 9,857,091 B2
(45) Date of Patent: Jan. 2, 2018

(54) THERMOSTAT CIRCUITRY TO CONTROL POWER USAGE

(71) Applicant: Honeywell International Inc., Morristown, NJ (US)

(72) Inventors: Kurt Robideau, Zimmerman, MN (US); Patrick R. Lemire, La Prairie (CA); Robert D. Juntunen, Minnetonka, MN (US)

(73) Assignee: Honeywell International Inc., Morris Plains, NJ (US)

( * ) Notice: Subject to any disclaimer, the term of this patent is extended or adjusted under 35 U.S.C. 154(b) by 707 days.

(21) Appl. No.: 14/088,312

(22) Filed: Nov. 22, 2013

(65) Prior Publication Data

US 2015/0144706 A1 May 28, 2015

(51) Int. Cl.
*F24F 11/00* (2006.01)

(52) U.S. Cl.
CPC ... *F24F 11/0086* (2013.01); *F24F 2011/0071* (2013.01); *F24F 2011/0091* (2013.01)

(58) Field of Classification Search
CPC ..... F24F 11/0086; F24F 2011/0071; F24F 2011/0091
See application file for complete search history.

(56) References Cited

U.S. PATENT DOCUMENTS 3,464,673 A 9/1969 Cargo et al.
3,665,159 A 5/1972 Becker et al.
3,899,713 A 8/1975 Barkan et al.
3,942,028 A 3/1976 Baker
4,078,720 A 3/1978 Nurnberg
4,079,366 A 3/1978 Wong
4,093,943 A 6/1978 Knight
(Continued)

FOREIGN PATENT DOCUMENTS

CA 1035448 A 7/1978
DE 3334117 A1 4/1985
(Continued)

OTHER PUBLICATIONS

Inventek, "Inventek Systems, ISM4319-M3X-L44-X Embedded Serial-to-Wi-Fi Module eS-WiFi™ 802.11 b/g/n Data Sheet", Inventek: Billerica, Feb. 6, 2012 (accessed from <<http://www.inventeksys.com/wp-content/uploads/2013/02/ISM4319_M3x_I44_Functional_Spec.pdf>>on Jul. 25, 2016).*
(Continued)

*Primary Examiner* — Kenneth M Lo
*Assistant Examiner* — Michael J Huntley
(74) *Attorney, Agent, or Firm* — Seager, Tufte & Wickhem LLP

(57) ABSTRACT

An operation alteration of a network attached thermostat to control power usage. Control wires for a heating and air conditioning system may be connected to a thermostat control circuit configured to control the system. A power extraction circuit may be coupled to the control wires configured to extract power from the control wires. The power may be put into a storage device. The power may be provided to the thermostat control circuit and a WiFi radio module. The radio module may provide a network connection for the thermostat. Circuitry and techniques may be provided to reduce power usage by the thermostat components.

19 Claims, 5 Drawing Sheets

28

| | 31 | 32 | 33 | 34 | 35 | 36 | 37 | 38 |
|---|---|---|---|---|---|---|---|---|
| | C-WIRE PRESENT? | LOAD IMPEDANCE | POWER AVAILABLE FROM C-WIRE OR HVAC WIRES | SUPER CAP CHARGE | PING CHECKIN PERIOD (SECONDS) | TCP SOCKET TIMEOUT (SECONDS) | POWER USAGE BY HVAC CONTROL CIRCUIT OR RADIO MODULE | ALLOW DATA SESSION? |
| 41 | YES | NA | HIGH | NA | 5 | 15 | HIGH | YES |
| 42 | NO | 100 (LOW) | HIGH | FULL | 5 | 15 | HIGH | YES |
| 43 | NO | 100 (LOW) | HIGH | MEDIUM | 10 | 15 | HIGH | YES |
| 44 | NO | 100 (LOW) | HIGH | LOW | 30 | 5 | LOW | NO |
| 45 | NO | 1000 (MEDIUM) | MEDIUM | FULL | 10 | 10 | MEDIUM | YES |
| 46 | NO | 1000 (MEDIUM) | MEDIUM | MEDIUM | 30 | 10 | MEDIUM | YES |
| 47 | NO | 1000 (MEDIUM) | MEDIUM | LOW | 45 | 5 | LOW | NO |
| 48 | NO | 3000 (HIGH) | LOW | HIGH | 20 | 10 | MEDIUM | YES |
| 49 | NO | 3000 (HIGH) | LOW | MEDIUM | 45 | 5 | MEDIUM | YES |
| 50 | NO | 3000 (HIGH) | LOW | LOW | 120 | 5 | LOW | NO |

(56) References Cited

U.S. PATENT DOCUMENTS 4,151,387 A 4/1979 Peters, Jr.
4,174,807 A 11/1979 Smith et al.
4,197,571 A 4/1980 Grunert
4,206,872 A 6/1980 Levine
4,224,615 A 9/1980 Penz
4,232,819 A 11/1980 Bost
4,257,555 A 3/1981 Neel
4,264,034 A 4/1981 Hyltin et al.
4,274,045 A 6/1981 Goldstein
4,296,334 A 10/1981 Wong
4,298,946 A 11/1981 Hartsell et al.
4,300,199 A 11/1981 Yoknis et al.
4,308,991 A 1/1982 Peinetti et al.
4,316,256 A 2/1982 Hendricks et al.
4,332,352 A 6/1982 Jaeger
4,337,822 A 7/1982 Hyltin et al.
4,337,893 A 7/1982 Flanders et al.
4,373,664 A 2/1983 Barker et al.
4,379,483 A 4/1983 Farley
4,382,544 A 5/1983 Stewart
4,384,213 A 5/1983 Bogel
4,386,649 A 6/1983 Hines et al.
4,388,692 A 6/1983 Jones et al.
4,431,134 A 2/1984 Hendricks et al.
4,446,913 A 5/1984 Krocker
4,479,604 A 10/1984 Didner
4,503,471 A 3/1985 Hanajima et al.
4,504,778 A 3/1985 Evans
4,506,827 A 3/1985 Jamieson et al.
4,556,169 A 12/1985 Zervos
4,585,164 A 4/1986 Butkovich et al.
4,606,401 A 8/1986 Levine et al.
4,621,336 A 11/1986 Brown
4,622,544 A 11/1986 Bially et al.
4,628,201 A 12/1986 Schmitt
4,641,013 A 2/1987 Dunnigan et al.
4,646,964 A 3/1987 Parker et al.
4,692,596 A 9/1987 Payne
4,706,177 A 11/1987 Josephson
4,717,333 A 1/1988 Carignan
4,725,001 A 2/1988 Carney et al.
4,745,300 A 5/1988 Kammerer et al.
4,745,311 A 5/1988 Iwasaki
4,806,843 A 2/1989 Mertens et al.
4,811,163 A 3/1989 Fletcher
4,829,779 A 5/1989 Munson et al.
4,837,731 A 6/1989 Levine et al.
4,881,686 A 11/1989 Mehta
4,918,439 A 4/1990 Wozniak et al.
4,939,995 A 7/1990 Feinberg
4,942,613 A 7/1990 Lynch
4,948,040 A 8/1990 Kobayashi et al.
4,969,508 A 11/1990 Tate et al.
4,992,779 A 2/1991 Sugino et al.
4,997,029 A 3/1991 Otsuka et al.
5,005,365 A 4/1991 Lynch
5,012,973 A 5/1991 Dick et al.
5,025,134 A 6/1991 Bensoussan et al.
5,036,698 A 8/1991 Conti
5,038,851 A 8/1991 Mehta
5,053,752 A 10/1991 Epstein et al.
5,065,813 A 11/1991 Berkeley et al.
5,081,411 A 1/1992 Walker
5,086,385 A 2/1992 Launey et al.
5,088,645 A 2/1992 Bell
5,118,963 A 6/1992 Gesin
5,120,983 A 6/1992 Samann
5,140,310 A 8/1992 DeLuca et al.
5,161,606 A 11/1992 Berkeley et al.
5,170,935 A 12/1992 Federspiel et al.
5,172,565 A 12/1992 Wruck et al.
5,181,653 A 1/1993 Foster et al.
5,187,797 A 2/1993 Nielsen et al.
5,192,874 A 3/1993 Adams
5,210,685 A 5/1993 Rosa
5,221,877 A 6/1993 Falk
5,226,591 A 7/1993 Ratz
5,230,482 A 7/1993 Ratz et al.
5,238,184 A 8/1993 Adams
5,251,813 A 10/1993 Kniepkamp
5,259,445 A 11/1993 Pratt et al.
5,272,477 A 12/1993 Tashima et al.
5,277,244 A 1/1994 Mehta
5,289,047 A 2/1994 Broghammer
5,294,849 A 3/1994 Potter
5,329,991 A 7/1994 Mehta et al.
5,348,078 A 9/1994 Dushane et al.
5,351,035 A 9/1994 Chrisco
5,361,009 A 11/1994 Lu
5,386,577 A 1/1995 Zenda
5,390,206 A 2/1995 Rein et al.
5,404,934 A 4/1995 Carlson et al.
5,414,618 A 5/1995 Mock et al.
5,429,649 A 7/1995 Robin
5,439,441 A 8/1995 Grimsley et al.
5,452,197 A 9/1995 Rice
5,482,209 A 1/1996 Cochran et al.
5,495,887 A 3/1996 Kathnelson et al.
5,506,572 A 4/1996 Hills et al.
5,526,422 A 6/1996 Keen
5,537,106 A 7/1996 Mitsuhashi
5,544,036 A 8/1996 Brown, Jr. et al.
5,566,879 A 10/1996 Longtin
5,570,837 A 11/1996 Brown et al.
5,579,197 A 11/1996 Mengelt et al.
5,590,831 A 1/1997 Manson et al.
5,603,451 A 2/1997 Helander et al.
5,654,813 A 8/1997 Whitworth
5,668,535 A 9/1997 Hendrix et al.
5,671,083 A 9/1997 Connor et al.
5,673,850 A 10/1997 Uptegraph
5,679,137 A 10/1997 Erdman et al.
5,682,206 A 10/1997 Wehmeyer et al.
5,711,785 A 1/1998 Maxwell
5,732,691 A 3/1998 Maiello et al.
5,736,795 A 4/1998 Zuehlke et al.
5,761,083 A 6/1998 Brown, Jr. et al.
5,782,296 A 7/1998 Mehta
5,801,940 A 9/1998 Russ et al.
5,810,908 A 9/1998 Gray et al.
5,818,428 A 10/1998 Eisenbrandt et al.
5,833,134 A 11/1998 Ho et al.
5,839,654 A 11/1998 Weber
5,840,094 A 11/1998 Osendorf et al.
5,862,737 A 1/1999 Chin et al.
5,873,519 A 2/1999 Beilfuss
5,886,697 A 3/1999 Naughton et al.
5,899,866 A 5/1999 Cyrus et al.
5,902,183 A 5/1999 D'Souza
5,903,139 A 5/1999 Kompelien
5,909,429 A 6/1999 Satyanarayana et al.
5,915,473 A 6/1999 Ganesh et al.
5,917,141 A 6/1999 Naquin, Jr.
5,917,416 A 6/1999 Read
D413,328 S 8/1999 Kazama
5,937,942 A 8/1999 Bias et al.
5,947,372 A 9/1999 Tiernan
5,950,709 A 9/1999 Krueger et al.
6,009,355 A 12/1999 Obradovich et al.
6,013,121 A 1/2000 Chin et al.
6,018,700 A 1/2000 Edel
6,020,881 A 2/2000 Naughton et al.
6,032,867 A 3/2000 Dushane et al.
D422,594 S 4/2000 Henderson et al.
6,059,195 A 5/2000 Adams et al.
6,081,197 A 6/2000 Garrick et al.
6,084,523 A 7/2000 Gelnovatch et al.
6,089,221 A 7/2000 Mano et al.
6,101,824 A 8/2000 Meyer et al.
6,104,963 A 8/2000 Cebasek et al.
6,119,125 A 9/2000 Gloudeman et al.
6,121,875 A 9/2000 Hamm et al.
6,140,987 A 10/2000 Stein et al.
6,141,595 A 10/2000 Gloudeman et al.

(56) References Cited

U.S. PATENT DOCUMENTS 6,145,751 A 11/2000 Ahmed
6,149,065 A 11/2000 White et al.
6,152,375 A 11/2000 Robison
6,154,081 A 11/2000 Pakkala et al.
6,167,316 A 12/2000 Gloudeman et al.
6,190,442 B1 2/2001 Redner
6,192,282 B1 2/2001 Smith et al.
6,196,467 B1 3/2001 Dushane et al.
6,205,041 B1 3/2001 Baker
6,208,331 B1 3/2001 Singh et al.
6,216,956 B1 4/2001 Ehlers et al.
6,236,326 B1 5/2001 Murphy
6,259,074 B1 7/2001 Brunner et al.
6,260,765 B1 7/2001 Natale et al.
6,285,912 B1 9/2001 Ellison et al.
6,288,458 B1 9/2001 Berndt
6,290,140 B1 9/2001 Pesko et al.
D448,757 S 10/2001 Okubo
6,315,211 B1 11/2001 Sartain et al.
6,318,639 B1 11/2001 Toth
6,321,637 B1 11/2001 Shanks et al.
6,330,806 B1 12/2001 Beaverson et al.
6,344,861 B1 2/2002 Naughton et al.
6,351,693 B1 2/2002 Monie et al.
6,356,038 B2 3/2002 Bishel
6,385,510 B1 5/2002 Hoog et al.
6,394,359 B1 5/2002 Morgan
6,397,612 B1 6/2002 Kemkamp et al.
6,398,118 B1 6/2002 Rosen et al.
6,448,896 B1 9/2002 Bankus et al.
6,449,726 B1 9/2002 Smith
6,453,687 B2 9/2002 Sharood et al.
D464,948 S 10/2002 Vasquez et al.
6,460,774 B2 10/2002 Sumida et al.
6,466,132 B1 10/2002 Caronna et al.
6,478,233 B1 11/2002 Shah
6,490,174 B1 12/2002 Kompelien
6,502,758 B2 1/2003 Cottrell
6,507,282 B1 1/2003 Sherwood
6,512,209 B1 1/2003 Yano
6,518,953 B1 2/2003 Armstrong
6,518,957 B1 2/2003 Lehtinen et al.
6,546,419 B1 4/2003 Humpleman et al.
6,556,899 B1 4/2003 Harvey et al.
6,566,768 B2 5/2003 Zimmerman et al.
6,574,537 B2 6/2003 Kipersztok et al.
6,578,770 B1 6/2003 Rosen
6,580,950 B1 6/2003 Johnson et al.
6,581,846 B1 6/2003 Rosen
6,587,739 B1 7/2003 Abrams et al.
6,595,430 B1 7/2003 Shah
6,596,059 B1 7/2003 Greist et al.
D478,051 S 8/2003 Sagawa
6,608,560 B2 8/2003 Abrams
6,619,055 B1 9/2003 Addy
6,619,555 B2 9/2003 Rosen
6,621,507 B1 9/2003 Shah
6,622,925 B2 9/2003 Carner et al.
6,635,054 B2 10/2003 Fjield et al.
6,663,010 B2 12/2003 Chene et al.
6,671,533 B2 12/2003 Chen et al.
6,685,098 B2 2/2004 Okano et al.
6,702,811 B2 3/2004 Stewart et al.
6,726,112 B1 4/2004 Ho
D492,282 S 6/2004 Lachello et al.
6,771,996 B2 8/2004 Bowe et al.
6,783,079 B2 8/2004 Carey et al.
6,786,421 B2 9/2004 Rosen
6,789,739 B2 9/2004 Rosen
6,801,849 B2 10/2004 Szukala et al.
6,807,041 B2 10/2004 Geiger et al.
6,808,524 B2 10/2004 Lopath et al.
6,810,307 B1 10/2004 Addy
6,810,397 B1 10/2004 Qian et al.
6,824,069 B2 11/2004 Rosen
6,833,990 B2 12/2004 LaCroix et al.
6,842,721 B2 1/2005 Kim et al.
6,851,621 B1 2/2005 Wacker et al.
6,868,293 B1 3/2005 Schurr et al.
6,893,438 B2 5/2005 Hall et al.
6,934,862 B2 8/2005 Sharood et al.
D512,208 S 12/2005 Kubo et al.
6,973,410 B2 12/2005 Seigel
7,001,495 B2 2/2006 Essalik et al.
D520,989 S 5/2006 Miller
7,050,026 B1 5/2006 Rosen
7,055,759 B2 6/2006 Wacker et al.
7,080,358 B2 7/2006 Kuzmin
7,083,109 B2 8/2006 Pouchak
7,083,189 B2 8/2006 Ogata
7,084,774 B2 8/2006 Martinez
7,089,088 B2 8/2006 Terry et al.
7,108,194 B1 9/2006 Hankins, II
7,130,719 B2 10/2006 Ehlers et al.
D531,588 S 11/2006 Peh
7,133,748 B2 11/2006 Robinson
D533,515 S 12/2006 Klein et al.
7,146,253 B2 12/2006 Hoog et al.
7,152,806 B1 12/2006 Rosen
7,156,318 B1 1/2007 Rosen
7,163,156 B2 1/2007 Kates
7,188,002 B2 3/2007 Chapman, Jr. et al.
D542,236 S 5/2007 Klein et al.
7,212,887 B2 5/2007 Shah et al.
7,222,800 B2 5/2007 Wruck et al.
7,225,054 B2 5/2007 Amundson et al.
7,231,605 B1 6/2007 Ramakasavan
7,232,075 B1 6/2007 Rosen
7,240,289 B2 7/2007 Naughton et al.
7,244,294 B2 7/2007 Kates
7,261,762 B2 8/2007 Kang et al.
7,263,283 B2 8/2007 Knepler
7,274,973 B2 9/2007 Nichols et al.
7,302,642 B2 11/2007 Smith et al.
7,331,187 B2 2/2008 Kates
7,331,426 B2 2/2008 Jahkonen
7,341,201 B2 3/2008 Stanimirovic
7,354,005 B2 4/2008 Carey et al.
RE40,437 E 7/2008 Rosen
7,419,532 B2 9/2008 Sellers et al.
7,435,278 B2 10/2008 Terlson
7,451,606 B2 11/2008 Harrod
7,452,396 B2 11/2008 Terlson et al.
7,476,988 B2 1/2009 Mulhouse et al.
7,489,094 B2 2/2009 Steiner et al.
7,496,627 B2 2/2009 Moorer et al.
7,500,026 B2 3/2009 Fukanaga et al.
7,505,914 B2 3/2009 McCall
7,542,867 B2 6/2009 Steger et al.
7,556,207 B2 7/2009 Mueller et al.
7,574,283 B2 8/2009 Wang et al.
7,584,897 B2 9/2009 Schultz et al.
7,594,960 B2 9/2009 Johansson
7,595,613 B2 9/2009 Thompson et al.
7,600,694 B2 10/2009 Helt et al.
7,604,046 B2 10/2009 Bergman et al.
7,617,691 B2 11/2009 Street et al.
7,642,674 B2 * 1/2010 Mulhouse ..... H02J 7/34 307/112
7,644,591 B2 1/2010 Singh et al.
7,665,019 B2 2/2010 Jaeger
7,676,282 B2 3/2010 Bosley
7,692,559 B2 4/2010 Face et al.
7,707,189 B2 4/2010 Haselden et al.
7,713,339 B2 5/2010 Johansson
7,739,282 B1 6/2010 Smith et al.
7,755,220 B2 7/2010 Sorg et al.
7,770,242 B2 8/2010 Sell
7,786,620 B2 8/2010 Vuk et al.
7,793,056 B2 9/2010 Boggs et al.
7,814,516 B2 10/2010 Stecyk et al.
7,837,676 B2 11/2010 Sinelnikov et al.
7,838,803 B1 11/2010 Rosen
7,852,645 B2 12/2010 Fouquet et al.

(56) References Cited

U.S. PATENT DOCUMENTS 7,859,815 B2 12/2010 Black et al.
7,865,252 B2 1/2011 Clayton
7,941,431 B2 5/2011 Bluhm et al.
7,952,485 B2 5/2011 Schecter et al.
7,956,719 B2 6/2011 Anderson, Jr. et al.
7,957,775 B2 6/2011 Allen, Jr. et al.
7,984,220 B2 7/2011 Gerard et al.
7,992,764 B2 8/2011 Magnusson
7,992,794 B2 8/2011 Leen et al.
8,032,254 B2 10/2011 Amundson et al.
8,060,470 B2 11/2011 Davidson et al.
8,087,593 B2 1/2012 Leen
8,091,796 B2 1/2012 Amundson et al.
8,110,945 B2 2/2012 Simard et al.
8,138,634 B2 3/2012 Ewing et al.
8,167,216 B2 5/2012 Schultz et al.
8,183,818 B2 5/2012 Elhalis
8,216,216 B2 7/2012 Warnking et al.
8,219,249 B2 7/2012 Harrod et al.
8,239,066 B2 8/2012 Jennings et al.
8,276,829 B2 10/2012 Stoner et al.
8,280,556 B2 10/2012 Besore et al.
8,314,517 B2 11/2012 Simard et al.
8,346,396 B2 1/2013 Amundson et al.
8,417,091 B2 4/2013 Kim et al.
8,437,878 B2 5/2013 Grohman et al.
8,532,190 B2 9/2013 Shimizu et al.
8,554,374 B2 10/2013 Lunacek et al.
8,574,343 B2 11/2013 Bisson et al.
8,613,792 B2 12/2013 Ragland et al.
8,621,881 B2 1/2014 Votaw et al.
8,623,117 B2 1/2014 Zavodny et al.
8,629,661 B2 1/2014 Shimada et al.
8,680,442 B2 3/2014 Reusche et al.
8,704,672 B2 4/2014 Hoglund et al.
8,729,875 B2 5/2014 Vanderzon
8,731,723 B2 5/2014 Boll et al.
8,734,565 B2 5/2014 Hoglund et al.
8,768,341 B2 7/2014 Coutelou et al.
8,881,172 B2 11/2014 Schneider
8,886,179 B2 11/2014 Pathuri et al.
8,886,314 B2 11/2014 Crutchfield et al.
8,892,223 B2 11/2014 Leen et al.
8,902,071 B2 12/2014 Barton et al.
9,002,523 B2 4/2015 Erickson et al.
9,071,145 B2 6/2015 Simard et al.
9,080,784 B2 7/2015 Dean-Hendricks et al.
9,143,006 B2 9/2015 Lee et al.
9,206,993 B2 12/2015 Barton et al.
9,234,877 B2 1/2016 Hattersley et al.
9,264,035 B2 2/2016 Tousignant et al.
9,272,647 B2 3/2016 Gawade et al.
9,366,448 B2 6/2016 Dean-Hendricks et al.
9,374,268 B2 6/2016 Budde et al.
9,419,602 B2 8/2016 Tousignant et al.
2001/0029585 A1 10/2001 Simon et al.
2001/0052459 A1 12/2001 Essalik et al.
2002/0011923 A1 1/2002 Cunningham et al.
2002/0022991 A1 2/2002 Sharood et al.
2002/0082746 A1 6/2002 Schubring et al.
2002/0092779 A1 7/2002 Essalik et al.
2002/0181251 A1* 12/2002 Kompelien ..... H02M 5/293 363/17
2003/0033230 A1 2/2003 McCall
2003/0034897 A1 2/2003 Shamoon et al.
2003/0034898 A1 2/2003 Shamoon et al.
2003/0040279 A1 2/2003 Ballweg
2003/0060821 A1 3/2003 Hall et al.
2003/0103075 A1 6/2003 Rosselot
2003/0177012 A1 9/2003 Drennan
2004/0262410 A1 12/2004 Hull
2005/0083168 A1 4/2005 Breitenbach
2005/0270151 A1 12/2005 Winick
2006/0112700 A1 6/2006 Choi et al.
2006/0196953 A1 9/2006 Simon et al.
2006/0242591 A1 10/2006 Van Dok et al.
2007/0013534 A1 1/2007 DiMaggio
2007/0045429 A1 3/2007 Chapman, Jr. et al.
2007/0114293 A1 5/2007 Gugenheim
2007/0114295 A1 5/2007 Jenkins et al.
2007/0119961 A1 5/2007 Kaiser
2007/0241203 A1 10/2007 Wagner et al.
2007/0277061 A1 11/2007 Ashe
2007/0289731 A1 12/2007 Deligiannis et al.
2007/0290924 A1 12/2007 McCoy
2007/0296260 A1 12/2007 Stossel
2008/0015740 A1 1/2008 Osann
2009/0143880 A1 6/2009 Amundson et al.
2009/0165644 A1 7/2009 Campbell
2010/0084482 A1 4/2010 Kennedy et al.
2010/0204834 A1 8/2010 Comerford et al.
2011/0073101 A1 3/2011 Lau et al.
2011/0185895 A1 8/2011 Freen
2012/0126019 A1* 5/2012 Warren ..... F24F 11/0012 236/51
2012/0199660 A1* 8/2012 Warren ..... F24F 11/0012 236/1 C
2012/0233478 A1* 9/2012 Mucignat ..... H04L 12/2825 713/320
2012/0273580 A1* 11/2012 Warren ..... F24F 11/0012 236/1 C
2012/0323377 A1 12/2012 Hoglund et al.
2012/0325919 A1* 12/2012 Warren ..... F24F 11/0012 236/1 C
2013/0158714 A1 6/2013 Barton et al.
2013/0158715 A1 6/2013 Barton et al.
2013/0158717 A1 6/2013 Zywicki et al.
2013/0158718 A1 6/2013 Barton et al.
2013/0158720 A1 6/2013 Zywicki et al.
2013/0213952 A1 8/2013 Boutin et al.
2013/0238142 A1 9/2013 Nichols et al.
2013/0245838 A1 9/2013 Zywicki et al.
2013/0261807 A1 10/2013 Zywicki et al.
2014/0062672 A1* 3/2014 Gudan ..... G06K 19/0715 340/10.33
2014/0312131 A1 10/2014 Tousignant et al.
2014/0312697 A1 10/2014 Landry et al.
2015/0001930 A1 1/2015 Juntunen et al.
2015/0115045 A1* 4/2015 Tu ..... F24F 11/0086 236/1 C
2015/0370265 A1 12/2015 Ren et al.
2015/0370268 A1 12/2015 Tousignant et al.
2016/0010880 A1 1/2016 Bravard et al.

FOREIGN PATENT DOCUMENTS

EP 0070414 A1 1/1983
EP 0434926 B1 8/1995
EP 0678204 B1 3/2000
EP 0985994 A1 3/2000
EP 1033641 A1 9/2000
EP 1143232 A1 10/2001
EP 1074009 B1 3/2002
EP 2138919 A1 12/2009
FR 2491692 A1 4/1982
FR 2711230 A1 4/1995
WO 9711448 A1 3/1997
WO 9739392 A1 10/1997
WO 0043870 A2 7/2000
WO 0152515 A1 7/2001
WO 0179952 A1 10/2001
WO 0223744 A2 3/2002
WO 2010021700 A1 2/2010

OTHER PUBLICATIONS

ST Microelectronics. "Connectivity line, ARM®-based 32-bit MCU with 64/256 KB Flash, USB OTG, Ethernet, 10 timers, 2 CANs, 2 ADCs, 14 communication interfaces" (accessed from <<http://www.st.com/content/ccc/resource/technical/document/datasheet/e4/f3/1a/89/5a/02/46/ae/CD00220364.pdf/files/CD00220364.pdf/jcr:content/translations/en.CD00220364.pdf>>).*

(56) References Cited

OTHER PUBLICATIONS

U.S. Appl. No. 14/088,306, filed Nov. 22, 2013.
U.S. Appl. No. 14/300,228, filed Jun. 9, 2014.
U.S. Appl. No. 14/300,232, filed Jun. 9, 2014.
U.S. Appl. No. 14/301,175, filed Jun. 10, 2014.
Lux TX500 Series Smart Temp Electronic Thermostat, 3 pages, prior to Jul. 7, 2004.
Lux TX9000 Installation, 3 pages, prior to Apr. 21, 2005.
Lux, "9000RF Remote Instructions," 2 pages, prior to Nov. 30, 2007.
Lux, "511 Series Smart Temp Electronic Thermostat," Owner's Manual, 3 pages, prior to Jul. 7, 2004.
Lux, "600 Series Smart Temp Electronic Thermostat," Owner's Manual, 3 pages, prior to Jul. 7, 2004.
Lux, "602 Series Multi-Stage Programmable Thermostat," Owner's Manual, 2 pages, prior to Jul. 7, 2004.
Lux, "60512110 Series Programmable Heat Pump Thermostat," Owner's Manual, 3 pages, prior to Jul. 7, 2004.
Lux, "70019000 Series Smart Temp Electronic Thermostat," Owner's Manual, 3 pages, prior to Jul. 7, 2004.
Lux, "PSPH521 Series Programmable Heat Pump Thermostat," Owner's Manual, 3 pages, prior to Jul. 7, 2004.
Lux, "TX1500 Series Smart Temp Electronic Thermostat," Owner's Manual, 6 pages, prior to Jul. 7, 2004.
METASYS, "HVAC PRO for Windows User's Manual," 308 pages, 1998.
Mounting Template for Ritetemp Thermostat 8082, 1 page, 2002.
OMRON Electronic Components, LLC, "Micro Tilt Sensor D6B," Cat. No. BO2WAD1, 2 pages, Jun. 2002.
OMRON Electronic Components, LLC, "Micro Tilt Sensor D6B," Cat. No. JB301-E3-01, 6 pages, Mar. 2005.
Operation Manual for Ritetemp Touch Screen Thermostat 8082, 8 pages, 2002.
PG&E, "SmartAC Thermostat Programming Web Site Guide," 2 pages, prior to Sep. 7, 2011.
Proliphix, 2004. "Web Enabled IP Thermostats, Intelligent HVAC Control," Proliphix Inc., 2 pages, on or before Aug. 28, 2004.
Proliphix, "Web Enabled IP Thermostats, Ultimate in Energy Efficiency!," Proliphix Inc., 2 pages, on or before Aug. 28, 2004.
Proliphix, Inc., "NT10e & NT20e," 54 pages, on or before Aug. 30, 2005.
Quick Start Guide for Ritetemp Thermostat 8082, 1 page, 2002.
Remote Control Power Requirement for Ritetemp Thermostat 8082, 1 page, 2002.
Ritetemp Operation 8029, 3 pages, Jun. 19, 2002.
Ritetemp Operation 8050, 5 pages, Jun. 26, 2002.
Ritetemp Operation 8085, pp. 1-6, prior to Apr. 21, 2005.
Saravanan et al, "Recontigurable Wireless Interface for Networking Sensors," IJCSNS International Journal of computer Science and Network Security, vol. 8 No. 7, pp. 270-276. Revised Jul. 20, 2008.
Screenshot of http://lagotek.com/index.html?currentSection=Touchlt, Lagotek, 1 page, prior to Mar. 29, 2012.
Sealed Unit Parts Co., Inc., Supco & CTC Thermostats . . . loaded with features, designed for value!, 6 pages, prior to Apr. 21, 2005.
Sharp Corporation, "GP1S036HEZ Phototransistor Output, Transmissive Photointerrupter with Tilt Direction (4-Direction) Detecting," pp. 1-11, Oct. 3, 2005.
Signetics Linear Products, "TDA1024 Zero Crossing Triac Trigger," Product Specification, 14 pages, Sep. 1985.
Totaline Model P474-1035 Owner's Manual Programmable 5-2 Day Digital Thermostat, pp. 1-21, Apr. 2003.
Totaline Star CPE230RF, Commercial Programmable Thermostat Wireless Transmitter, Owner's Manual, pp. 1-16, Oct. 1998.
Totaline Star P/N P474-0130 Non-Programmable Digital Thermostat Owner's Manual, pp. 1-22, prior to Apr. 21, 2005.
Totaline, "1 for All Programmable Digital Thermostat," Owner's Manual P/N P374-1100, 24 pages, Apr. 2001.
Totaline, 1998. "1 for All Programmable Digital Thermostat," Owner's Manual P/N P374-1100FM, 23 pages, Nov. 1998.
Totaline, "1 for All Programmable Digital Thermostat," Owner's Manual P/N P474-1050, 21 pages, Nov. 1998.
Totaline, 2001. "Intellistat Combination Temperature and Humidity Control," Owner's Manual P/N P374-1600, 25 pages, Jun. 2001.
Totaline, "P/N P374-0431 Thermostat Remote Control and Receiver," Owner's Manual, 11 pages, prior to Nov. 30, 2007.
Totaline, "P474-1100RF, P474-1100REC Wireless Thermostat," 1 page, prior to Nov. 30, 2007.
Totaline, "Programmable Thermostat Configurable for Advanced Heat Pump or Dual Fuel Operation," Owner's Manual P/N P374-1500, 24 pages, Jun. 1999.
Totaline, "Wireless Remote Sensor, Model P474-0401-1RF/Rec," 2 pages, prior to Nov. 30, 2007.
Totaline, "Instructions P/N P474-1010", Manual, 2 pages, Dec. 1998.
Totaline, "Programmable Thermostat", Homeowner's Guide, 27 pages, Dec. 1998.
Totaline, "Wireless Programmable Digital Thermostat," Owner's Manual 474-1100RF, 22 pages, 2000.
Trane, "System Programming, Tracer Summit Version 14, BMTW-SVP01D-EN," 623 pages, 2002.
Trane, "Wireless Zone Sensor. Where Will Wireless Technology Take You?," 4 pages, Feb. 2006.
Travis Industries, Remote Fireplace Thermostat, Part #99300651, 6 pages, printed Feb. 3, 2003.
Trouble Shooting Guide for Ritetemp Thermostat 8082, 1 page, 2002.
Visor Handheld User Guide, 280 pages, Copyright 1999-2000.
Warmly Yours, "Model TH111GFCI-P (120 VAC)," Manual, pp. 1-4, prior to Jul. 7, 2004.
Mite-Rodgers 1F80-224 Programmable Electronic Digital Thermostat, Installation and Operation Instructions, 8 pages, prior to Apr. 21, 2005.
White-Rodgers Comfort-Set III Thermostat, pp. 1-44, prior to Jul. 7, 2004.
White-Rodgers Installation Instructions for Heating & Air Conditioning IF78 5/2 Day Programmable Thermostat, 7 pages, prior to Jul. 7, 2004.
White-Rodgers Installation Instructions for Heating & Air Conditioning IF78 Non-Programmable Thermostat, 6 pages, prior to Apr. 21, 2005.
White-Rodgers, "Installation Instructions for Heating & Air Conditioning IF72 5/2 Day Programmable Heat Pump Thermostat," 8 pages, prior to Jul. 7, 2004.
White-Rodgers, "Comfort-Set 90 Series Thermostat," Manual, pp. 1-24, prior to Jul. 7, 2004.
White-Rodgers, 1F80-240 "(for Heating Only systems) Programmable Electronic Digital Thermostat," Installation and Operation Instructions, 8 pages, prior to Jul. 7, 2004.
White-Rodgers, 1F80-241 "Programmable Electronic Digital Thermostat," Installation and Operation Instructions, 6 pages, prior to Jul. 7, 2004.
White-Rodgers, 1F80-261 "Programmable Electronic Digital Thermostat," Installation and Operation Instructions, 8 pages, prior to Jul. 7, 2004.
White-Rodgers, 1F81-261 "Programmable Electronic Digital Multi-Stage Thermostat," Installation and Operation Instructions, 8 pages, prior to Jul. 7, 2004.
White-Rodgers, 1F82-261 "Programmable Electronic Digital Heat Pump Thermostat," Installation and Operation Instructions, 8 pages, prior to Jul. 7, 2004.
White-Rodgers, Comfort-Set 90 Series Premium, 4 pages, prior to Apr. 21, 2005.
www.icmcontrols.com, Simplecomfort, SC3000 Single Stage Heat/Single Stage Cool or Single Stage Heat Pump/Manual Changeover, 1 page, prior to Jul. 7, 2004.
www.icmcontrols.com, Simplecomfort, SC3001 Single Stage Heat/Single Stage Cool or Single Stage Heat Pump/Manual Changeover, 1 page, prior to Jul. 7, 2004.
www.icmcontrols.com, Simplecomfort, SC3006 Single Stage Heat/Single Stage Cool or Single Stage Heat Pump/Manual Changeover, 1 page, prior to Jul. 7, 2004.

(56) References Cited

OTHER PUBLICATIONS vvww.icmcontrols.com, Simplecomfort, SC3201 2 Stage Heat Pump Manual Changeover, 1 page, prior to Jul. 7, 2004.
www.icmcontrols.com, Simplecomfort, SC3801 2 Stage Heat/2 Stage Cool 2 Stage Heat Pump/Audio Changeover, 1 page, prior to Jul. 7, 2004.
Freudenthal et al., "Communicating Extensive Smart Home Functionality to Users of All Ages: the Design of a Mixed-Initiative Multimodal Thermostat-Interface," pp. 34-39, Mar. 12-13, 2001.
Gentex Corporation, HD135, 135° Fixed Temperature Heat Detector AC Pwered, 120V, 60Hz With Battery Backup, Installation Instructions—Owner's Information, pp. 1-5, Jun. 1, 1998.
Gentex Corporation, 9000 Series, Photoelectric Type Single Station/Multi-Station Smoke Alarms AC Powered With Battery Backup, Installation Instructions—Owner's Information, pp. 9-1 to 9-6, Jan. 1, 1993.
Harris et al., "Optimizing Memory Transactions," Microsoft Research Havard University, 12 pages, May 25, 2012.
Hendon Semiconductors, "OM1894 Dual Sensing Precision Triac Control," Product Specification, Rev. 2.0, 21 pages, Apr. 19, 2007.
Honeywell Brivis Deluxe Programmable Thermostat, pp. 1-20, 2002.
Honeywell Brivis T8602C Chronotherm IV Deluxe Programmable Thermostats, Installation Instructions, pp. 1-12, 2002.
Honeywell CT8602C Professional Fuel Saver Thermostat, pp. 1-6, 1995.
Honeywell Electronic Programmable Thermostat, Owner's Guide, pp. 1-20, 2003.
Honeywell Electronic Programmable Thermostats, Installation Instructions, pp. 1-8, 2003.
Honeywell News Release, "Honeywell's New Sysnet Facilities Integration System for Boiler Plant and Combustion Safety Processes," 4 pages, Dec. 15, 1995.
Honeywell T8002 Programmable Thermostat, Installation Instructions, pp. 1-8, 2002.
Honeywell T8602A,B,C,D and TS8602A,C Chronotherm III Fuel Saver Thermostats, Installation Instructions, pp. 1-12, 1995.
Honeywell T8602D Chronotherm IV Deluxe Programmable Thermostats, Installation Instructions, pp. 1-12, 2002.
Honeywell TH8000 Series Programmable Thermostats, Owner's Guide, pp. 1-44, 2004.
Honeywell, "Excel Building Supervisor-Integrated R7044 and FS90 Ver. 2.0," Operator Manual, 70 pp., Apr. 1995.
Honeywell, "Installation Guide: Wireless Entry/Exit Remote," 12 pages, 2011.
Honeywell, "Introduction of the S7350A Honeywell WebPAD Information Appliance," Home and Building Control Bulletin, 2 pages, Aug. 29, 2000; Picture of WebPad Device with touch screen, 1 page; and screen shots of WebPad Device, 4 pages.
Honeywell, "RedLINK™ Wireless Comfort Systems," RedLINK Wireless Technology, 8 pages, Aug. 2011.
Honeywell, "System Installation Guide: Important Instructions," Honeywell International Inc., 25 pages, 2011.
Honeywell, "Total Connect Online Help Guide," Revision A, 800-02577-TC, Mar. 2010.
Honeywell, "Total Connect User Guide," Revision B, 34 pages, May 15, 2012.
Honeywell, 2012. "VisionPRO® 8000 Thermostats," downloaded from http://yourhome.honeywell.com, 2 pages, May 24, 2012.
Honeywell, "W7006A Home Controller Gateway User Guide," 31 pages, Jul. 2001.
Honeywell, MagicStat® CT3200 Programmable Thermostat, Installation and Programming Instructions, pp. 1-24, 2001.
Honeywell, Wireless Entry/Exit Remote, Operating Manual, 9 pages, 2011.
http://hunter-thermostats.com/hunter_programmable_thermostats.html, Hunter Thermostat 44668 Specifications, and 14758 Specifications, 2 pages, Printed Jul. 13, 2011.
http://www.cc.gatech.edu/computing/classes/cs6751_94_fall-groupdclimate-2/node1.html, "Contents," 53 pages, printed Sep. 20, 2004.
http://www.dimplex.com/en/home_heating/linear_convector_baseboards/products/Ipc_series/inear_proportional_convector, Dimplex Coporation, "Linear Convector LPC Series," 2 pages, May 2011.
http://www.enernetcorp.com/, Enernet Corporation, "Wireless Temperature Control" 1 page 2011.
http://www.enernetcorp.com/t9000-wireless-thermostat.html, Enernet Corporation, "T9000 Series Wireless Fan Coil Thermostat," Product Brochure, 2 pages, 2011.
http://www.enocean-alliance.org/en/products/regulvar_rw-ssr347-15a/, Regulvar Corporation, "RW-SSR347-15A, Relais sans fil à semi-conducteurs" 3 pages, Aug. 8, 2009.
http://www.enocean-alliance.org/en/products/regulvar_rw-tp01/, Regulvar Corporation, "RW-TP01, Capteur de température sans fil" 3 pages, Aug. 9, 2009.
http://www.forwardthinking.honeywell.com/products/wireless/focus_pro/focus_pro_feature.html, Honeywell Corporation, "Wireless FocusPRO® pages", 2 pages, 2011.
http://www.ritetemp.info/rtMenu_13.html, Rite Temp 8082, 6 pages, printed Jun. 20, 2003.
http://www.thermostatsales.com, Robertshaw, "9610 Digital Programmable Thermostat," 3 pages, printed Jun. 17, 2004.
http://www.thermostatsales.com, Robertshaw, "9700 Deluxe Programmable Thermostat" 3 pages, printed Jun. 17, 2004.
http://www.thermostatsales.com, Robertshaw, "9710 Deluxe Programmable Thermostat," 3 pages, printed Jun. 17, 2004.
http://www.thermostatsales.com, Robertshaw, "9720 Deluxe Programmable Thermostat," 3 pages, printed Jun. 17, 2004.
Hunter, "44200/44250," Owner's Manual, 32 pages, prior to Jul. 7, 2004.
Hunter, "44300/44350," Owner's Manual, 35 pages, prior to Jul. 7, 2004.
Hunter, "Auto Saver 550", Owner's Manual Model 44550, 44 pages, prior to Jul. 7, 2004.
Hunter, "Model 44758 Remote Sensor," Owner's Manual, 2 pages, Revision Sep. 4, 2008.
Install Guide for Ritetemp Thermostat 8082, 6 pages, 2002.
Invensys™, "9700i 9701i 9715i 9720i Deluxe Programmable Thermostats," User's Manual, pp. 1-28, prior to Jul. 7, 2004.
Larsson, "Battery Supervision in Telephone Exchanges," Ericsson Components AB Sweden, 5 pages, Downloaded May 5, 2012.
Lennox, "Network Control Panel (NCP)," User's Manual, 18 pages, Nov. 1999.
Lennox, "Prodigy Control System," Lennox Industries, 4 pages, May 25, 2012.
Logitech, "Harmony 880 Remote User Manual," v. 1, pp. 1-15, prior to Nov. 30, 2007.
Lux ELV1 Programmable Line Voltage Thermostat, Installation Instructions, 3 pages, prior to Jul. 7, 2004.
"RCS X10 Thermostat Plug-in for HomeSeer Beta Version 2.0. 105," 25 pages, prior to Sep. 7, 2011.
"CorAccess Systems/In Home," http://web.archive.org/web20011212084427/www.coraccess.com/home.html, 1 page, copyright 2001, printed Aug. 19, 2004.
"HAI Company 2004. Background," http://www.homeauto.com/AboutHAI/abouthai_main.htm, 2 pages, printed Aug. 19, 2004.
"High-tech options take hold in new homes—Aug. 28, 2000—Dallas Business Journal," http://bizjoumals.com/dallas/stories/2000/08/28/focus4, 3 pages, dated Aug. 28, 2000, printed Aug. 19, 2004.
"Home Toys Review—Touch Linc", http://www.hometoys.com/htinews/aug99/reviews/touchlinc/touchlinc.htm, 3 pages, dated Aug. 1999, printed Aug. 20, 2004.
"HTI News Release," http://www.hometoys.com/htinews/apr99/releases/ha101.htm, 3 pages, Apr., 1999.
"Mark of Excellence Award Finalist Announced," http://64.233.167.104/search?Q=cache:ciOA2YtYaBIJ:www.hometoys.com/releases/mar. . . , 6 pages, Leopard Touchscreen on p. 2, dated prior to Mar. 4, 2000, printed Aug. 20, 2004.

(56) References Cited

OTHER PUBLICATIONS

"Product Review—Philips Pronto Remote Control," http://hometheaterhifi.com/volume_6_2/philipsprontoremotecontrol.html, 5 pages, dated May 1999, printed Aug. 20, 2004.
"RC X10 Automation Forum: Control your Heating and Cooling System with Pronto(1/1)," http://www.remotecentral.com/cgi-bin/mboard/rc-x10/thread.cgi?12, 2 pages, dated Apr. 23, 1999, printed Aug. 20, 2004.
"Spotlight on integrated systems," Custom Builder, vol. 8, No. 2, p. 66(6), Mar.-Apr. 1993.
"Vantage Expands Controls for AudioNideo, HVAC and Security," http://www.hometoys.com/htinews/aug99/releases/vantage03.htm, 2 pages, dated Aug. 3, 1999, printed Aug. 20, 2004.
ADI, "Leopard User Manual," 93 pages, 2001.
Adicon 2500, "The Automator," 4 pages, Oct.-Dec. 2000.
ADT Security Services, "iCenter Advanced User Interface 8142ADT," Installation and Setup Guide, 4 pages, May 2001; First Sale Feb. 2001.
AED Electronics, Inc., "Presenting Climatouch the Most Innovative Thermostat in the World!," 2 pages, prior to Nov. 30, 2007.
Andrews et al., "Clicky: User-Centric Input for Active Spaces," 17 pages, Aug. 2004.
Aprilaire Electronic Thermostats Models 8344, 8346, 8348, 8363, 8365, 8366 Operating Instructions, 8 pages, 2003.
Aube Technologies, Electronic Thermostat for Heating System Model TH135-01, 5 pages, Aug. 14, 2001.
Aube Technologies, TH140-28 Electronic Programmable Thermostat, Installation Instructions and User Guide, pp. 1-4, Jan. 22, 2004.
AutomatedBuildings.com Article—"Thin Client" Solutions, "Pressure, Air Flow, Temperature, Humidity & Valves," Dwyer Instruments, Inc., 5 pages, printed Sep. 20, 2004.
Blake et al., "Seng 310 Final Project Demo Program" Illustration, 3 pages, Apr. 6, 2001.
Blake et al., "Seng 310 Final Project" Report, dated Apr. 6, 2001.
Blister Pack Insert from a Ritetemp 8082 Touch Screen Thermostat Product, 2 pages, 2002.
Braeburn Model 3000 Owner's Manual, pp. 1-13, 2001.
Braeburn Model 5000 Owner's Manual, pp. 1-17, 2001.
BRK Electronics Maximum Protection Plus Ultimate Convenience Smoke Alarm, 24 pages, Sep. 2000.
BRK First Alert, User's Manual, Smoke and Fire Alarms, pp. 1-7, Nov. 2002.
Business Wire, "MicroTouch Specialty Products Group to Capitalize on Growing Market for Low-Cost Digital Matrix Touchscreens," p1174 (2 pages), Jan. 6, 1999.
Cardio Manual, available at http://www.secantca/En/Documentation/Cardio2é-Manual.pdf, Cardio Home Automation Inc., 55 pages, printed Sep. 28, 2004.
Cardio, by Secant; http://www.hometoys.com/htinews/apr98/reviews/cardio.htm, "HTINews Review," Feb. 1998, 5 pages, printed Sep. 14, 2004.
Carrier Microelectronic Programmable Thermostat Owner's Manual, pp. 1-24, May 1994.
Carrier TSTATCCRFO1 Programmable Digital Thermostat, pp. 1-21, prior to Apr. 21, 2005.
Carrier, "Edge Performance Programmable Owner's Manual," 64 pages, 2007.
Carrier, "Programmable Dual Fuel Thermostats," Installation, Start-Up & Operating Instructions, pp. 1-12, Oct. 1998.
Carrier, "Programmable Thermostats," Installation, Start-Up & Operating Instructions, pp. 1-16, Sep. 1998.
Carrier, "Standard Programmable Thermostat," Homeowner's Manual, pp. 1-8 pp., 1998.
Carrier, "Thermidistat Control, Installation, Start-Up, and Operating Instructions," pp. 1-12, Aug. 1999.
Carrier, "Comfort Programmable Owner's Manual," Carrier Touch-N-Go, Catalog No: 0M-TCPHP-4CA 60 pages, 2010.
Cirrus Logic, Inc., "CS1501 Digital Power Factor Correction Control IC," 16 pages, 2012.
Climatouch, User Manual, Climatouch CTO3TSB Thermostat, Climatouch CTO3TSHB Thermostat with Humidity Control, Outdoor UHF Temperature Transmitter 217S31, 19 pages, Printed Sep. 15, 2004.
International Search Report for Corresponding Application No. PCT/US2014/044229, dated Oct. 13, 2014.
CorAccess, "Companion 6," User Guide, pp. 1-20, Jun. 17, 2002.
Danfoss RT51/51RF & RT52/52RF User Instructions, 2 pages, Jun. 2004.
DeKoven et al., "Designing Collaboration in Consumer Products," 2 pages, 2001.
DeKoven et al., "Measuring Task Models in Designing Intelligent Products," 2 pages, Jan. 13-16, 2002.
DESA Heating Products, "Wireless Hand-Held Remote Control Sets Models (C) GHRCB and (C)GHRCTB, Operating Instructions," 4 pages, May 2003.
Domotique Secant Home Automation—Web Page, available at http://www.secant.ca/En/Company/Default.asp, 1 page, printed Sep. 28, 2004.
Emme Core User Guide, Version 1.1, 47 pages, Jan. 2011.
Firex Smoke Alarm, Ionization Models AD, ADC Photoelectric Model Pad, 4 pages, prior to Apr. 21, 2005.
Fluke, "561 HVAC Pro" Infrared Thermometer User's Manual, 22 pages, Downloaded May 24, 2012.

* cited by examiner

28

| | 31 | 32 | 33 | 34 | 35 | 36 | 37 | 38 |
|---|---|---|---|---|---|---|---|---|
| | C-WIRE PRESENT? | LOAD IMPEDANCE | POWER AVAILABLE FROM C-WIRE OR HVAC WIRES | SUPER CAP CHARGE | PING CHECKIN PERIOD (SECONDS) | TCP SOCKET TIMEOUT (SECONDS) | POWER USAGE BY HVAC CONTROL CIRCUIT OR RADIO MODULE | ALLOW DATA SESSION? |
| 41 | YES | NA | HIGH | NA | 5 | 15 | HIGH | YES |
| 42 | NO | 100 (LOW) | HIGH | FULL | 5 | 15 | HIGH | YES |
| 43 | NO | 100 (LOW) | HIGH | MEDIUM | 10 | 15 | HIGH | YES |
| 44 | NO | 100 (LOW) | HIGH | LOW | 30 | 5 | LOW | NO |
| 45 | NO | 1000 (MEDIUM) | MEDIUM | FULL | 10 | 10 | MEDIUM | YES |
| 46 | NO | 1000 (MEDIUM) | MEDIUM | MEDIUM | 30 | 10 | MEDIUM | YES |
| 47 | NO | 1000 (MEDIUM) | MEDIUM | LOW | 45 | 5 | LOW | NO |
| 48 | NO | 3000 (HIGH) | LOW | HIGH | 20 | 10 | MEDIUM | YES |
| 49 | NO | 3000 (HIGH) | LOW | MEDIUM | 45 | 5 | MEDIUM | YES |
| 50 | NO | 3000 (HIGH) | LOW | LOW | 120 | 5 | LOW | NO |

FIGURE 4

THERMOSTAT CIRCUITRY TO CONTROL POWER USAGE

BACKGROUND

The present disclosure pertains to thermostats and particularly to circuitry related to thermostats and heating and air conditioning systems.

SUMMARY

The disclosure reveals an operation alteration of a network attached thermostat to control power usage. Control wires for a heating and air conditioning system may be connected to a thermostat control circuit configured to control the system. A power extraction circuit may be coupled to the control wires configured to extract power from the control wires. The power may be put into a storage device. The power may be provided to the thermostat control circuit and a WiFi radio module. The radio module may provide a network connection for the thermostat. Circuitry and techniques may be provided to reduce power usage by the thermostat components.

BRIEF DESCRIPTION OF THE DRAWING

FIG. 4 is a diagram of a table that may illustrate some example conditional situations of the present example of a thermostat system.

DESCRIPTION

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

Figure 1:
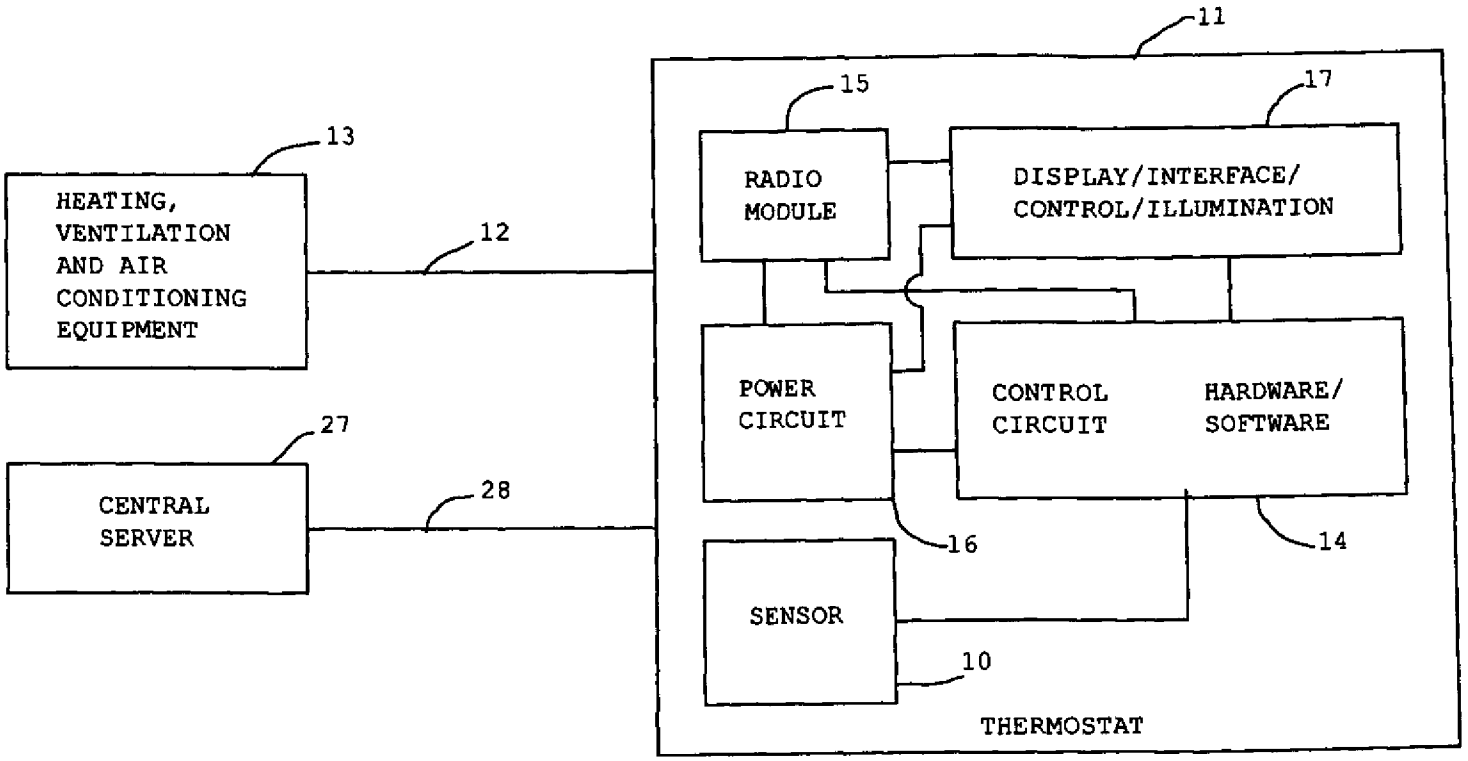
FIG. 1 is a diagram of an illustrative example of a thermostat utilizing power extraction and saving features.

FIG. 1 is a diagram of an illustrative example of a thermostat 11 that may incorporate HVAC control wires 12 for controlling an HVAC system 13, a thermostat control circuit 14 configured to control HVAC system 13, a sensor 10 coupled to thermostat control circuit 14 to provide sensed data, a WiFi radio module 15 coupled to thermostat control circuit 14 to provide a network connection for thermostat 11, and a power circuit 16 coupled to the HVAC control wires 12 for providing power to thermostat control circuit 14, WiFi radio module 15 and display interface 17.

Power circuit 16 may incorporate a power extraction circuit 20 configured to extract power from HVAC control wires 12, a power storage device 21 configured to store electrical current extracted from HVAC control wires 12, common wire detection circuitry configured to detect the presence of a common wire among HVAC control wires 12, a key load determination circuitry configured to determine the electrical load impedance presented by the HVAC equipment in a fast manner, and a key rules table in control circuit 14 correlating the amount of power that can be extracted from HVAC control wires 12 with the load impedances 22, 23, 24 of the HVAC equipment drawing power through one of the impedances.

Display and illumination 17 may be retained on thermostat 11 with circuitry 25 that determines the amount of power stored in power storage device 21.

A communications protocol may be used for communications with the thermostat control circuit 14 and WiFi radio module 15. Messages may be sent using the communications protocol that informs thermostat control circuit 14 and WiFi radio module 15 of power parameters. The power parameters may incorporate presence of a common power terminal or C-wire 26, a charge on the power storage device 21, and an amount of power that can be extracted from HVAC equipment 13.

Common power terminal 26 may be present. A rate of recharge may be input to the logic of control circuit 14 to change behavior of the thermostat display 17 backlight.

Thermostat control circuit 14 may incorporate circuitry configured to control HVAC equipment 13, circuitry to display user information, circuitry to illuminate the device, software that may alter the power used by changing displayed user information and an amount and time of illumination, and a rules table that correlates device operation to several power parameters.

Figure 2:
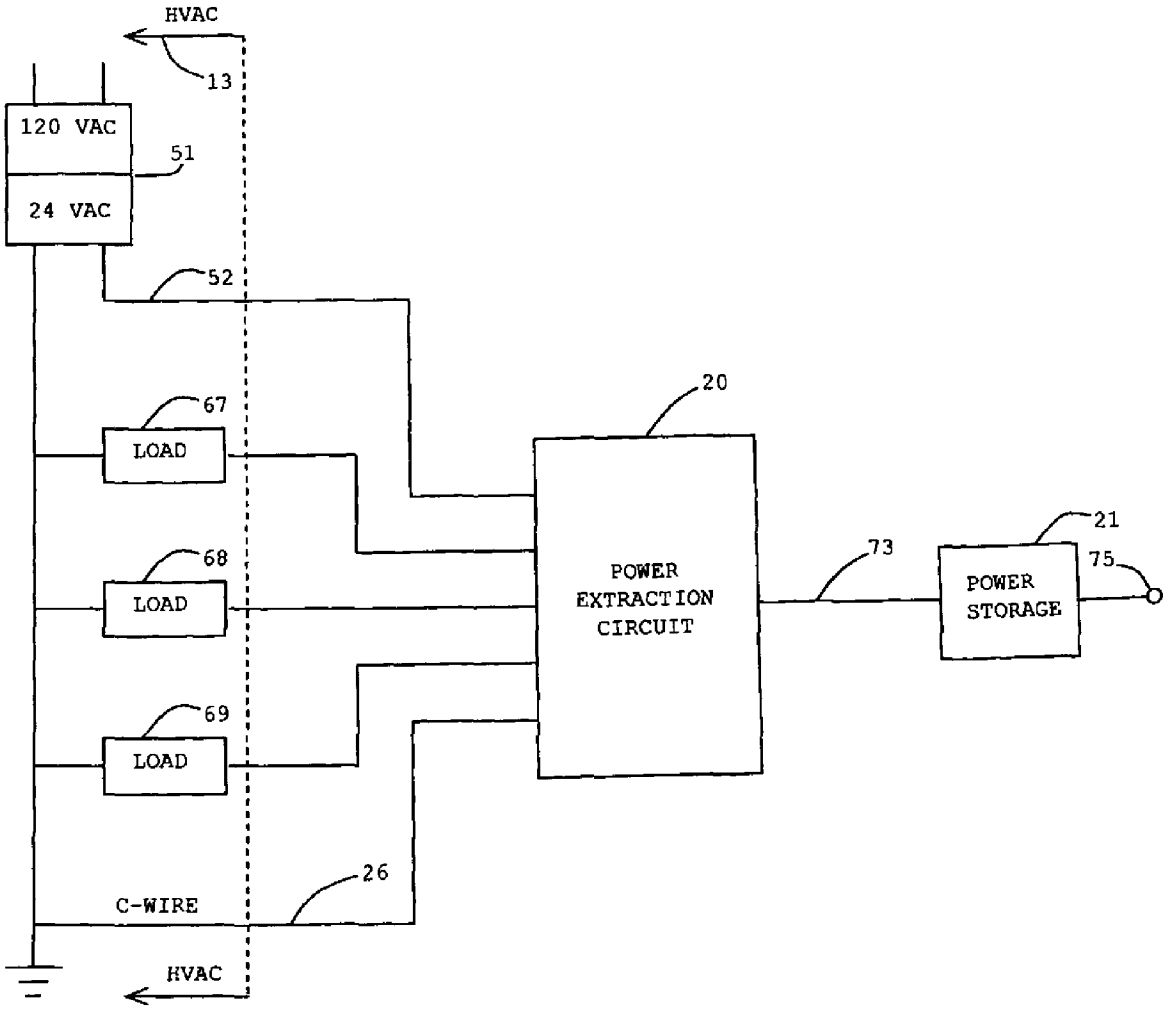
FIG. 2 is a diagram of a power extraction circuit.

FIG. 2 is a diagram of a power extraction circuit 20 and associated components. Power from a 120 VAC to 24 VAC transformer 51 may be provided on lines 26 and 52 to circuit 20. Power may be extracted from loads 67, 68 and 69 of an example HVAC 13. Other hardware may be implemented in lieu of HVAC 13. An output 73 from circuit 20 may go to a power storage unit 21. Power from unit 21 may be available on output 75.

Figure 3:
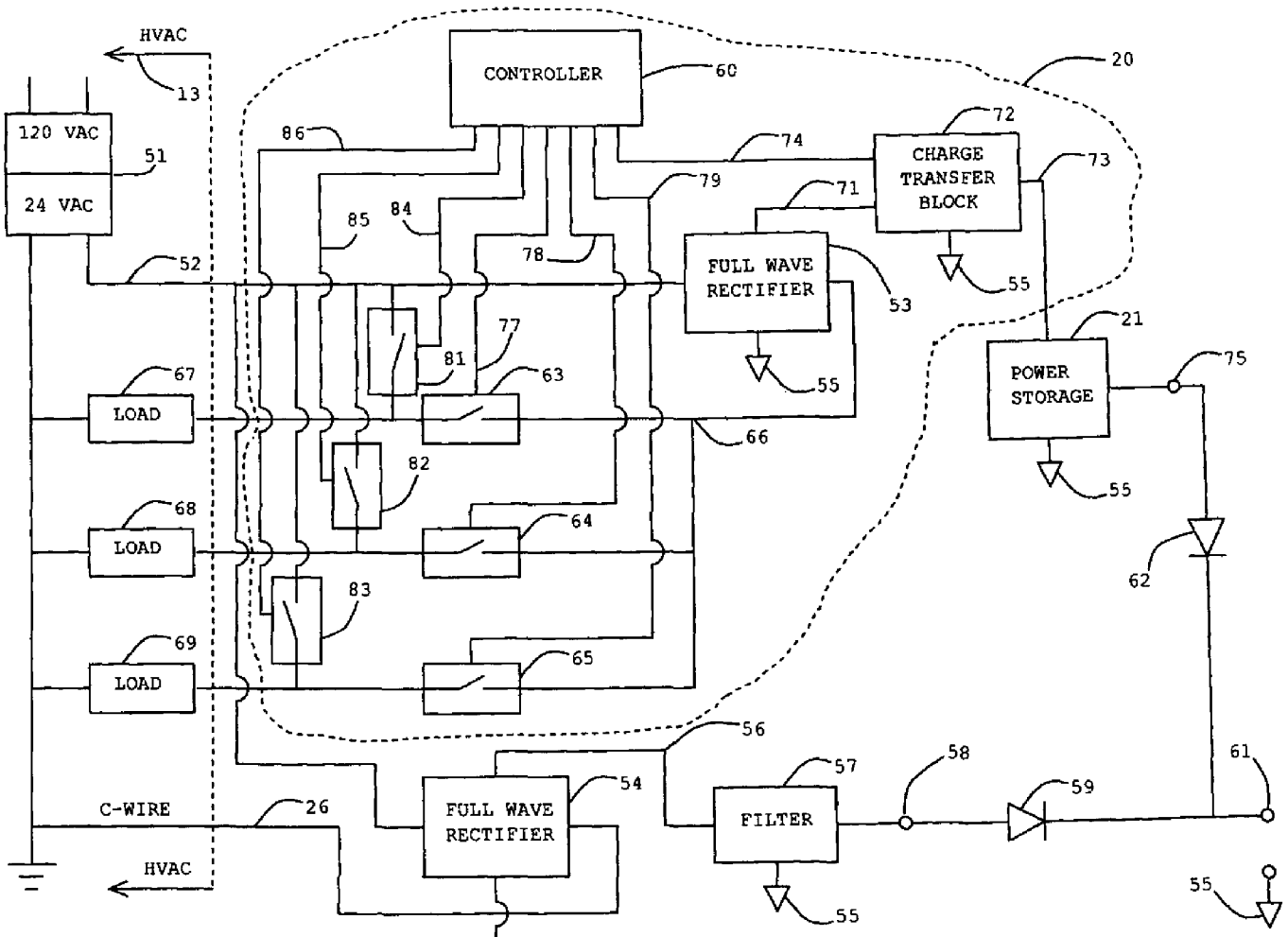
FIG. 3 is a diagram an illustrative example of the power extraction circuit.

FIG. 3 is a diagram of an illustrative example of power extraction circuit 20 plus several additional components. As noted herein, step-down transformer 51 may provide 24 VAC from line power of 120 VAC. One terminal of the 24 VAC output may be regarded as a C-wire 26 or common line. It may also be regarded as a reference or ground terminal 26. The other terminal of the 24 VAC output may be regarded a hot line or wire 52. Wire 52 may be connected to a first input terminal of a full wave rectifier 53 and a fuel wave rectifier 54. A second input to rectifier 54 may be C-wire 26. One output terminal of rectifier 54 may be connected to a reference voltage ground terminal 55. Another terminal 56 may be connected to an input of a filter 57. Filter 57 may also be connected to ground terminal 55.

An output 58 may go to an anode of a diode 59. A cathode of diode may be connected to an output terminal 61. The output from diode 59 may be noted as power available from a C-wire that is present. Diode 59 may prevent an output from a diode 62 having a higher voltage than the output from diode 59 and overriding output 58. Diodes 59 and 62 may be substituted with switches of one kind or another (e.g., FET switch). In the latter situation, one switch at most may be on though both switches may be off. The switches may be controlled by a controller 60.

In the meanwhile, there may be power transformed from current going through a load of equipment such as HVAC equipment. Terminal 52 may be providing 24 VAC relative to terminal 26 to a first input terminal of rectifier 53. Controller 60 may turn on a relay switch 63 via a line 77. Current may flow through rectifier 53 and out on a conductor 66 and through switch 63 that is closed. The current may flow from switch 63 through a load 67 to C-wire or ground terminal 26 of voltage supply 56.

An output on line 71 may go from rectifier 53 to an input of a charge transfer block 72 relative to ground terminal 55. Current may flow from an output of charge transfer block 72 on a line to an input of a power storage device 21. Device 21 may a super or ultra capacitor or other mechanism for electrical power storage. A transfer of current or charge to storage device 21 may be monitored and/or controlled by controller 60 via a line 74. Detection of an amount of charge or voltage on storage device 21 may be accomplished via line 74 by controller 60.

Power, current at a certain voltage level, may go from an output 75 through diode 62 (anode first) to output 61. As indicated herein, diode 62 may be replaced by a different component such as a FET switch.

In a similar manner as taking power from current going through load 67, power may be taken from current going through loads to 68 and 69. Load switches 64 and 65 for loads 68 and 69, respectively, may be operated by controller 60 via lines 78 and 79. Loads 67, 68 and 69 may be different in terms of impedance. For example, loads 67, 68 and 69 may have impedances of 100, 1,000 and 3,000 ohms, respectively. Load impedances may be other than the noted examples. Switches 63, 64 and 65 as controlled by controller 60 may select an appropriate load from which power is taken and transformed into a charge to be stored in storage device 21.

Rectifier 53 may be bypassed with respect to the current from equipment loads 67, 68 and 69. Relays or switches 81, 82 and 83 may be closed to limit the circuitry of the respective loads across lines 52 and 26. Relays or switches 81, 82 and 83 may be controlled individually by lines 84, 85 and 86 from controller 60 to the relays or switches.

FIG. 4 is a diagram of table 28 that may illustrate some example conditional situations of the present example of a thermostat system. If a common wire 26 is present as indicated by column 31 and row 41, thermostat control circuit 14 may use more power (e.g., more current at a given voltage) as indicated by column 37 and row 41. If common wire 26 is not present, and the amount of power that can be extracted from HVAC control wires 12 is high, then thermostat control circuit 14 may use more power, as indicated by column 37 and rows 42 and 43. If common wire 26 is not present, and the amount of power that can be extracted from HVAC control wires 12 is low, thermostat control circuit 14 may use less power, as indicated by columns 33 and 37 and rows 48-50. If common wire 26 is not present, and the charge on storage device 21 is high, thermostat control circuit 14 may use more power. If common wire 26 is not present, and the charge on storage device 21 is low, thermostat control circuit 14 may use less power, as indicated by columns 34 and 35 and rows 44, 47 and 50.

WiFi radio module 15 may incorporate circuitry configured to communicate with a WiFi router, networking algorithms to communicate through the WiFi router with a central server 27 via a connection 28, software that groups virtually all tasks to be performed in time, software that performs tasks periodically, TCP/IP components that contain networking constants controlling socket timeouts, software that can create network channels to transfer HVAC information between thermostat control circuit 14 and central server 27, software that can abort network communications, software that can alter the power used by changing the task period, networking constants, allowing or disallowing network channels and aborting network communications, and a rules table that correlates device operation to the power parameters (FIG. 1).

If common wire 26 is present, WiFi radio module 15 may use more power. If common wire 26 is not present, and the amount of power that can be extracted from HVAC control wires 12 is high, WiFi radio module 15 may use more power, as indicated by columns 33 and 37 and rows 42 and 43. If common wire 26 is not present, and the amount of power that can be extracted from HVAC control wires 12 is low, WiFi radio module 15 may use less power, as indicated by columns 33 and 37 and row 50. If common wire 26 is not present, and the charge on storage device is high 21, WiFi radio module 15 may use more power, as indicated by columns 34 and 37 and row 42. If common wire 26 is not present, and the charge on storage device 21 is low, WiFi radio module 15 may use less power, as indicated by columns 34 and 37 and row 44, 47 and 50. There may be various approaches for achieving low power on radio module 15.

Figure 5:
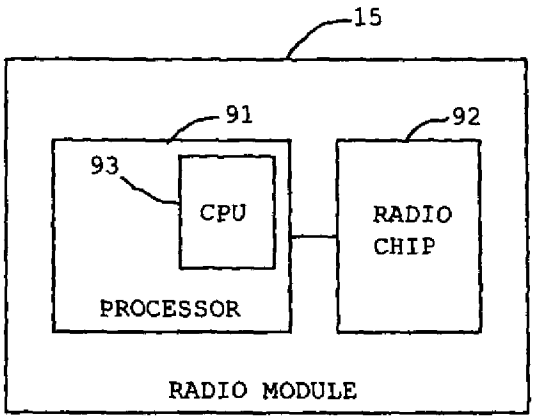
FIG. 5 is a diagram of an illustrative example of a radio module for a thermostat system.

FIG. 5 is a diagram of an illustrative example of a radio module 15 having a processor 91 and a radio chip 92. Radio module 15 may be a WiFi mechanism. Processor 91 may have an ARM core CPU 93 with peripherals provided by a chip vendor. ARM core CPU 93 may have a low power mode. Added to this item may be a low power mode provided by the chip vendor to reduce the power of the processor peripherals when in the stop mode.

Radio chip 92 may have a feature called power save, that reduces power when the radio is idle. A main task of radio module 15 may be to communicate with a server such as server 27. Communication with a server may take several forms. When thermostat data has changed, they may be sent to the server (async data). Periodically, radio module 15 may perform a ping checkin. The ping checkin may be a TCP packet sent to the server. The server may return a packet, which can contain a request for a "data session".

If a ping checkin contains a data session request, radio module 15 may open a TCP session with the server. Using this socket, the server may transmit data to radio module (and down to thermostat control circuit 14).

A basic technique may be noted. Low power may be achieved in radio module 15 by putting processor 93 into low power mode, and/or radio chip 92 into power save mode, when the application is idle.

The application may use a ThreadX™ (known by Express Logic, Inc.) RTOS. The name "ThreadX" is derived from the fact that threads are used as the executable modules and the letter "X" represents context switching, i.e., it switches threads. Virtually all of the work may be done in threads. The RTOS may run on a "tick", a 10 ms timer. When the tick occurs, the RTOS may go through the threads and determine which ones are "ready". The tasks may be executed, with the highest priority ones first.

To determine whether to put radio module 15 into low power mode, a function may go through the tasks on every tick. If none of the tasks are ready, the function may determine when the first task will be ready. If this time exceeds a threshold, the radio module may be put into low power mode for that period of time.

For example, one may assume that the threshold is set to 5 seconds. At tick 1, the tasks are ready. These tasks may be run, radio module 15 may stay awake. At tick 2, the soonest task may be ready in 1 tick. Radio module 15 may stay awake. At tick 3, the soonest task may be ready in 15 seconds. Radio module may be put into a low power mode for 15 seconds.

Background of the technique may be noted. A Broadcom Corporation code may be provided with radio module 15. The code may be called Wiced™. The approach may be known by an Express Logic, Inc., representative (a vendor of ThreadX). Express Logic provided code that could be used to walk through the task table and find the next ready task, as well as code required for keeping the ThreadX kernel time correct.

Task grouping may be noted. In order to allow for longer low power periods, the communication tasks may be combined. During a ping checkin event, async data may be sent to the server. A ping checkin may be performed. If requested, a data session may be opened and data can be transferred from the web to radio module 15.

Altering operation based C-wire 26, load and available power may be noted. Power extraction circuit 20 may provide power to radio module 15. Circuit 20 may provide several pieces of information to radio module 15 which can be used to alter the operation of the radio module 15.

If C-wire 26 is present, the device is not necessarily power limited. If C-wire 26 is not present, the device may be power limited. Power extraction circuit 20 may draw full power from a 24 volt line when the furnace/AC is on (load on), and steal a small amount of power when the furnace/AC is off (load off).

The amount of power that circuit 20 can draw when in the load off mode may be a function of the load impedance (e.g., resistance). Low load impedance may allow a (relatively) high power draw from the load with the furnace/AC is off. High load impedance may allow a lower power draw.

As an illustrative example, one may assume that the circuit 20 may apply a voltage across the load of 3 volts. A traditional relay based furnace may present a load impedance of 100 ohms. Power extraction circuit 20 may steal 3/100=30 mA. If a zone panel presents a load impedance of 3000 ohms, circuit 20 may steal 3/3000=1 mA.

Power extraction circuit 20 may store energy in a storage device such as a super capacitor 21. When depleted, capacitor 21 may be charged from power taken from the load. Circuit 20 may report the charge on super capacitor 20 to radio module 15.

Using these pieces of information, radio module 15 may change its behavior. Certain key parameters that affect power usage may be varied, such as a ping checkin period, TCP socket timeouts, and whether to accept data session requests.

Basic rules may incorporate the following items as may be guided by table 28 of FIG. 4. If C-wire is present, a device such as radio module 15 may run at optimal settings. If a load has high impedance, radio module 15 may know that a super capacitor charge rate will be slow. Radio module 15 may be rather conservative with its power settings. If the load has low impedance, the charge rate may be higher and thus more aggressive power settings of radio module 15 may be used. If the charge on super capacitor 21 is high, aggressive power settings of radio module may be used. If the charge is low, conservative settings of radio module may be used.

FIG. 4 is a diagram of table 28 showing examples of power usage. If power is low, transmission by radio module 15 may be aborted. While performing the communication tasks, radio module 15 may check with circuit 20 at key points to see if the power available has dropped to a critically low level. If so, the communication tasks may be aborted.

Thermostat data may be buffered while radio module 15 is in a low power mode. When radio module 15 is in the low power mode, and thermostat data changes, the following sequence may be followed. Thermostat 11 may assert an IO line to wake up radio module 15. Thermostat 11 may send the data to radio module 15. Radio module 15 may timestamp the data, buffer (store) the data, and then go back into the low power mode. When radio module 15 wakes up for scheduled transmission tasks, radio module 15 may send buffered data.

A network attached thermostat 11 with illumination and a user display may consume significant power. When the same thermostat 11 draws that power from a power extraction circuit, the available power may be limited. If thermostat 11 draws too much power, the illumination, display and network connection may be turned off. The present approach may avoid this issue by having extended knowledge of an ability of the power extraction circuit to provide power based on the particular HVAC equipment 13 installed. In addition, thermostat 11 may be designed to operate within that available power. In this manner, thermostat 11 may avoid having to turn off the illumination, display and network connection due to excessive power usage.

To recap, a thermostat may incorporate control wires that control heating, ventilation and air conditioning (HVAC) equipment, a thermostat control circuit configured to control the HVAC equipment, a radio module coupled to the thermostat control circuit to provide a network connection for the thermostat, and a power circuit system coupled to the control wires and providing power to the thermostat control circuit and the radio module.

The power circuit system may incorporate an extraction circuit configured to extract power from the control wires, a power storage device configured to store electrical current extracted from the control wires, common wire detection circuitry configured to detect a presence of a common wire among the control wires, and load determination circuitry configured to determine the electrical load impedance presented by HVAC equipment.

The power circuit system may further incorporate a rules table correlating the amount of power that can be extracted from the control wires with the load impedance of the HVAC equipment for determining the amount of power stored in the power storage device, and a communications protocol used for communications with the thermostat control circuit and the radio module. Messages are sent using the communications protocol that informs the thermostat control circuit and radio module of power parameters incorporating presence of the common wire, a charge on the power storage device and an amount of power that can be extracted from the HVAC equipment.

The thermostat control circuit may incorporate circuitry configured to control the HVAC equipment, a display, circuitry configured to show user information on the display, circuitry configured to illuminate the display, software configured to alter power used by changing the user information and an amount and time of illumination of the display, and a rules table that correlates thermostat operation to power parameters.

The rules table may incorporate one or more statements or items of a group consisting of: if the common wire is present, the thermostat control circuit uses more power than if the common wire is absent; if the common wire is absent, and the amount of power that can be extracted from the control wires is high, the thermostat control circuit uses more power than when the amount of power that can be extracted from the control wires is normal; if the common wire is absent, and the amount of power than that can be extracted from the control wires is low, the thermostat control circuit uses less power than when the amount of power that can be extracted from the control wires is normal; if the common wire is absent, and the charge on the power storage device is high, the thermostat control circuit uses more power than when the charge on the power storage device is normal; and/or if the common wire is absent present, and the charge on the power storage device is low, the thermostat control circuit uses less power than when the charge on the power storage device is normal. High may be greater than normal and normal may be greater than low.

The radio module may incorporate circuitry configured to communicate with a WiFi router, networking algorithms to communication through the WiFi router with a central server, software configured to group virtually all tasks to be performed in time, software configured to perform tasks periodically, TCP/IP configured to contain networking constants that control socket timeouts, software configured to create network channels for transfer of HVAC information between the thermostat control circuit and the central server, software configured to abort network communications, software configured to alter the power used by changing the task period, networking constants, allowing or disallowing network channels and aborting network communications, and/or a rules table that correlates thermostat operation to power parameters.

The rules table may incorporate one or more statements or items of a group consisting of: if the common wire is present, the WiFi radio module uses more power than if the common wire is absent; if the common wire is not present, and the amount of power that can be extracted from the control wires is high, the WiFi radio module uses more power than when the amount of power is normal; if the common wire is not present, and the amount of power that can be extracted from the control wires is low, the WiFi radio module uses less power than when the amount of power that can be extracted from the control wires is normal; if the common wire is not present, and the charge on the power storage device is high, the WiFi radio module uses more power than when the charge on the power storage device is normal; and if the common wire is not present, and the charge on the power storage device is low, the WiFi radio module uses less power than when the charge on the power storage is normal. High may be greater than normal and normal may be greater than low.

An approach for altering operation of a network attached thermostat to control power usage, may incorporate providing a thermostat for controlling HVAC equipment. The thermostat may incorporate a radio module, a power circuit, and a control circuit. The radio module may incorporate a processor and radio chip.

The approach may further incorporate reducing power of the processor peripherals with a stop mode of the processor, reducing power of the radio chip with a power save feature, and communicating with a server having the radio module.

The approach may further incorporate communicating with a server using the radio module. Communicating with the server may incorporate that when thermostat data have changed the data are sent to the server, a data session is had with the server, or there is a performance of a ping check-in as a TCP packet sent to the server.

The approach may further incorporate putting the processor into a stop mode and the radio chip into a power save mode to reduce power in the radio module when an application is idle.

The approach may further incorporate providing power from the power circuit to the radio module. The power circuit may draw a first amount of power from a voltage line when the HVAC equipment is on. The power circuit may extract a second amount of power when the HVAC equipment is off. The first amount of power may be greater than the second amount of power.

The second amount of power that the power circuit can extract may vary inversely with a load impedance with the HVAC equipment off.

The approach may further incorporate using the second amount of power to provide a charge to a super capacitor. The charge on the super capacitor may be available as power for the radio module.

A thermostat system may incorporate a power supply circuit configured for connection to heating, ventilation and air conditioning (HVAC) equipment, a control circuit connected to the power supply circuit, a radio module connected to the control circuit, and a sensor connected to the control circuit. The power supply circuit may incorporate a power extraction circuit having an output. The power extraction circuit may obtain power for the output from current through a load impedance of HVAC equipment.

The power extraction circuit may further incorporate a presence of a common power source wire that prevents the output from being necessarily limited in power. An absence of the common power source wire may cause the output to be limited in power from current through the load impedance of the HVAC equipment in an off mode, and from an amount of charge on a super capacitor. The amount of charge on the super capacitor may be obtained from current through the load impedance of the HVAC equipment in the off mode.

The radio module may incorporate a processor and a radio chip. The processor may have a stop mode. The radio chip may have a power save mode. Power consumption by the radio module may be reduced to a low power mode when the processor is in a stop mode or the radio chip is in a power save mode.

If the radio module is in the low power mode and thermostat data are new or vary, then the control circuit may wake up the radio module from the low power mode, and send the thermostat data to the radio module. The radio module may receive and store the thermostat data, and then return to the low power mode. The radio module may wake up for a scheduled transmission task and send the stored data to a predetermined destination.

Communication tasks of the radio module may be combined for increasing a period of the low power mode. The communication tasks may incorporate sending asynchronous data to a server and performing a ping check-in. If a data session is requested in the ping check-in, a data session may be opened and data be transferred from a server to the radio module.

The system may further incorporate a display. The display may incorporate illumination and a network connection that consumes a minimum amount of power. The minimum amount of power may be available from the power extraction circuit to prevent the display, the illumination, or the network connection from being turned-off.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A thermostat comprising:

control wires that control heating, ventilation and air conditioning (HVAC) equipment;

a thermostat control circuit configured to control the HVAC equipment;

a radio module coupled to the thermostat control circuit to provide a network connection for the thermostat; and a power circuit system coupled to the control wires and providing power to the thermostat control circuit and the radio module; and wherein the power circuit system comprises:

an extraction circuit configured to extract power from the control wires;

a power storage device configured to store electrical current extracted from the control wires;

common wire detection circuitry configured to detect a presence of a common wire among the control wires; and load determination circuitry configured to determine the electrical load impedance presented by HVAC equipment;

wherein the thermostat control circuit comprises:

a rules table that correlates thermostat operation to power parameters, the rules table including statements comprising:

if the common wire is absent and the amount of power that can be extracted from the control wires is high, the thermostat control circuit uses more power than when the amount of power that can be extracted from the control wires is normal;

if the common wire is absent and the amount of power that can be extracted from the control wires is low, the thermostat control circuit uses less power than when the amount of power that can be extracted from the control wires is normal; and wherein high is greater than normal and normal is greater than low; and wherein the radio module comprises TCP/IP configured to contain networking constants that control socket timeouts and the socket timeouts are adjusted based, at least in part, on a determined electrical load impedance presented by the HVAC equipment.

2. The thermostat of claim 1, wherein the power circuit system further comprises:

a rules table correlating the amount of power that can be extracted from the control wires with the load impedance of the HVAC equipment for determining the amount of power stored in the power storage device; and a communications protocol used for communications with the thermostat control circuit and the radio module; and wherein messages are sent using the communications protocol that informs the thermostat control circuit and radio module of power parameters incorporating presence of the common wire, a charge on the power storage device and an amount of power that can be extracted from the HVAC equipment.

3. The thermostat of claim 1, wherein the thermostat control circuit comprises:

circuitry configured to control the HVAC equipment;

a display;

circuitry configured to show user information on the display;

circuitry configured to illuminate the display; and software configured to alter power used by changing the user information and an amount and time of illumination of the display.

4. The thermostat of claim 1, wherein the rules table further comprises one or more statements of a group consisting of:

if the common wire is present, the thermostat control circuit uses more power than if the common wire is absent;

if the common wire is absent, and the charge on the power storage device is high, the thermostat control circuit uses more power than when the charge on the power storage device is normal; and if the common wire is absent present, and the charge on the power storage device is low, the thermostat control circuit uses less power than when the charge on the power storage device is normal.

5. The thermostat of claim 1, wherein the radio module comprises:

circuitry configured to communicate with a WiFi router;

networking algorithms to communication through the WiFi router with a central server;

software configured to group virtually all tasks to be performed in time;

software configured to perform tasks periodically;

software configured to create network channels for transfer of HVAC information between the thermostat control circuit and the central server;

software configured to abort network communications;

software configured to alter the power used by changing the task period, networking constants, allowing or disallowing network channels and aborting network communications; and a rules table that correlates thermostat operation to power parameters.

6. The thermostat of claim 5, wherein the rules table comprises one or more statements of a group consisting of:

if the common wire is present, the WiFi radio module uses more power than if the common wire is absent;

if the common wire is not present, and the amount of power that can be extracted from the control wires is high, the WiFi radio module uses more power than when the amount of power is normal;

if the common wire is not present, and the amount of power that can be extracted from the control wires is low, the WiFi radio module uses less power than when the amount of power that can be extracted from the control wires is normal;

if the common wire is not present, and the charge on the power storage device is high, the WiFi radio module uses more power than when the charge on the power storage device is normal;

if the common wire is not present, and the charge on the power storage device is low, the WiFi radio module uses less power than when the charge on the power storage is normal; and high is greater than normal and normal is greater than low.

7. A method for altering operation of a network attached thermostat to control power usage, comprising:

providing a thermostat for controlling HVAC equipment, wherein:

the thermostat comprises a radio module, a power circuit, and a control circuit; and the radio module comprises a processor and radio chip;

determining when a next communication task of the radio module will be ready;

comparing a time until the next communication task of the radio module will be ready to a threshold amount of time; and if the time until the next communication task of the radio module exceeds the threshold amount of time, putting the processor into a stop mode and the radio chip into a power save mode to reduce power in the radio module until the time until the next communication task of the radio module will be ready has expired;

wherein the radio module comprises TCP/IP configured to contain networking constants that control socket timeouts and the socket timeouts are adjusted based, at least in part, on a determined electrical load impedance presented by the HVAC equipment.

8. The method of claim 7, further comprising:

communicating with a server using the radio module.

9. The method of claim 7, further comprising:

communicating with a server using the radio module; and wherein:

communicating with the server comprises:

when thermostat data have changed, the data are sent to the server;

a data session is had with the server; or there is a performance of a ping check-in as a TCP packet sent to the server.

10. The method of claim 7, further comprising:

providing power from the power circuit to the radio module; and wherein:

the power circuit draws a first amount of power from a voltage line when the HVAC equipment is on;

the power circuit extracts a second amount of power when the HVAC equipment is off; and the first amount of power is greater than the second amount of power.

11. The method of claim 10, wherein the second amount of power that the power circuit can extract varies inversely with a load impedance with the HVAC equipment off.

12. The method of claim 11, further comprising:

using the second amount of power to provide a charge to a super capacitor; and wherein the charge on the super capacitor is available as power for the radio module.

13. A thermostat system comprising:

a power supply circuit configured for connection to heating, ventilation and air conditioning (HVAC) equipment;

a control circuit connected to the power supply circuit;

a radio module connected to the control circuit, the radio module including a processor having a stop mode and a radio chip having a power save mode; and a sensor connected to the control circuit;

wherein:

the power supply circuit comprises a power extraction circuit having an output; and the power extraction circuit can obtain power for the output from current through a load impedance of an HVAC equipment; and the radio module performs a ping check-in with a remote server periodically and a period between sequential ping check-ins is varied based, at least in part, on the load impedance of the HVAC equipment.

14. The system of claim 13, the power extraction circuit further comprises:

a presence of a common power source wire that prevents the output from being necessarily limited in power; and wherein:

an absence of the common power source wire causes the output to be limited in power from current through the load impedance of the HVAC equipment in an off mode, and from an amount of charge on a super capacitor; and the amount of charge on the super capacitor is obtained from current through the load impedance of the HVAC equipment in the off mode.

15. The system of claim 13, wherein power consumption by the radio module is reduced to a low power mode when the processor is in a stop mode or the radio chip is in a power save mode.

16. The system of claim 15, wherein:

if the radio module is in the low power mode and thermostat data are new or vary, then the control circuit wakes up the radio module from the low power mode, and sends the thermostat data to the radio module;

the radio module receives and stores the thermostat data, and then returns to the low power mode; and the radio module wakes up for a scheduled transmission task and sends the stored data to a predetermined destination.

17. The system of claim 15, wherein communication tasks of the radio module are combined for increasing a period of the low power mode.

18. The system of claim 17, wherein:

the communication tasks comprise:

sending asynchronous data to a server; and performing the ping check-in; and if a data session is requested in the ping check-in, a data session is opened and data are transferred from a server to the radio module.

19. The system of claim 13, further comprising:

a display; and wherein:

the display comprises illumination and a network connection that consumes a minimum amount of power; and the minimum amount of power is available from the power extraction circuit to prevent the display, the illumination, or the network connection from being turned-off.

* * * * *